US007458133B2

(12) United States Patent
Wing

(10) Patent No.: US 7,458,133 B2
(45) Date of Patent: Dec. 2, 2008

(54) REFRIGERATOR HANDLE ASSEMBLY WITH EXCHANGEABLE END CAPS

(75) Inventor: Forrest F. Wing, Des Moines, IA (US)

(73) Assignee: Maytag Corporation, Benton Harbor, MI (US)

( * ) Notice: Subject to any disclaimer, the term of this patent is extended or adjusted under 35 U.S.C. 154(b) by 261 days.

(21) Appl. No.: 11/033,548

(22) Filed: Jan. 12, 2005

(65) Prior Publication Data

US 2006/0207062 A1 Sep. 21, 2006

(51) Int. Cl.
*E05B 1/00* (2006.01)

(52) U.S. Cl. ..... 16/412; 16/436

(58) Field of Classification Search ..... 16/412, 16/413, 436, 443, 444, DIG. 40, DIG. 41; 248/254, 278.1, 256–257, 282.1, 261; 411/52, 411/53; 49/460, 461; 312/248.6, 401, 405; 403/381

See application file for complete search history.

(56) References Cited

U.S. PATENT DOCUMENTS

| | | | | | |
|---|---|---|---|---|---|
| 3,426,385 | A | | 2/1969 | Gutshall | |
| 3,766,598 | A | * | 10/1973 | Roberts | 16/444 |
| 3,995,349 | A | | 12/1976 | Roberts et al. | |
| 4,047,263 | A | | 9/1977 | Tietze | |
| 5,144,718 | A | * | 9/1992 | Ozawa | 16/412 |
| 5,303,451 | A | | 4/1994 | Graviss et al. | |
| 5,440,783 | A | * | 8/1995 | Allardyce et al. | 16/110.1 |
| 5,493,756 | A | * | 2/1996 | Shanok et al. | 16/412 |
| 5,562,090 | A | | 10/1996 | Katz | |
| 5,632,062 | A | | 5/1997 | Katz et al. | |
| 5,675,867 | A | | 10/1997 | Howie, Jr. | |
| 5,740,587 | A | * | 4/1998 | Onai et al. | 16/412 |
| 5,797,164 | A | * | 8/1998 | Donaghy | 16/412 |
| 6,546,597 | B2 | | 4/2003 | Atalla et al. | |
| 6,609,274 | B2 | | 8/2003 | Christensen et al. | |
| 6,629,339 | B2 | * | 10/2003 | Pohl et al. | 16/436 |
| 6,668,424 | B1 | * | 12/2003 | Allen et al. | 16/444 |
| 6,708,374 | B2 | * | 3/2004 | Mandel | 16/436 |
| 6,871,385 | B2 | * | 3/2005 | Wing et al. | 16/436 |
| 6,926,379 | B1 | * | 8/2005 | Grace et al. | 312/405 |
| 2002/0116791 | A1 | * | 8/2002 | Grady et al. | 16/444 |
| 2003/0056334 | A1 | * | 3/2003 | Finkelstein | 16/436 |
| 2003/0093876 | A1 | | 5/2003 | Jung et al. | |
| 2003/0110591 | A1 | * | 6/2003 | Christensen et al. | 16/412 |
| 2004/0181911 | A1 | * | 9/2004 | Tisol et al. | 16/412 |
| 2006/0085948 | A1 | * | 4/2006 | Brammer et al. | 16/412 |

FOREIGN PATENT DOCUMENTS

| | | | |
|---|---|---|---|
| EP | 0599160 | | 6/1994 |
| JP | 2002005561 | A * | 1/2002 |

* cited by examiner

*Primary Examiner*—Chuck Y. Mah
(74) *Attorney, Agent, or Firm*—Kirk Goodwin; Michael D. Lafrenz

(57) ABSTRACT

A handle assembly for mounting to a door of a refrigerator includes a main body portion having first and second end portions separated by an intermediate portion, wherein each of the first and second end portions includes a recessed section adapted to receive an end cap. Each of the end caps includes a mounting arrangement formed therein for receiving an attachment member, such as a clip or bracket. The handle is selectively mounted to a front face or side edge of the refrigerator door depending upon the end caps and attachment members selected.

20 Claims, 12 Drawing Sheets

REFRIGERATOR HANDLE ASSEMBLY WITH EXCHANGEABLE END CAPS

BACKGROUND OF THE INVENTION

1. Field of the Invention

The present invention pertains to the art of refrigerators and, more particularly, to a mounting arrangement for a handle on a refrigerator.

2. Discussion of the Prior Art

Conventional handle arrangements for refrigerators are formed from multiple pieces, including a handle frame and a handle piece having a gripping portion. Such a handle is typically mounted to a refrigerator cabinet utilizing screws which extend through the handle piece and frame, clamping the overall handle to a panel of the refrigerator cabinet. Once the handle is in place, a cover is inserted over each screw, with the cover extending only over the area of the screw or along substantially the entire length of the handle. In general, this known handle mounting arrangement is rather hard to assemble and often results in witness lines that take away from the overall aesthetics of the refrigerator.

Numerous other types of refrigerator handle arrangements are known in the art as well, with each of these handle arrangements being designed for a particular application. Regardless of the existence of various types of refrigerator handle arrangements and mounting systems, there still exists a need in the art for a universal refrigerator handle that is capable of being selectively mounted to either the front surface or side edge of a refrigerator door. Such a universal handle would provide significant cost savings because a single process would be used to make the handle grip portion, while additional parts necessary to mount the handle to the front surface or side edge of the refrigerator door could be easily fastened to the handle during assembly of the refrigerator.

SUMMARY OF THE INVENTION

The present invention pertains to a handle assembly for mounting to a door of a refrigerator. In accordance with the most preferred form of the invention, the handle assembly may be selectively mounted to a front face portion or a side edge of the refrigerator door. The handle assembly includes a main body portion having first and second end portions separated by an intermediate portion, wherein each of the first and second end portions include recessed sections adapted to receive one of a plurality of end caps. Each of the end caps includes a mounting arrangement formed therein for receiving an attachment member such as a clip or a bracket member. The handle assembly is selectively mounted to the front face or side edge of the refrigerator door depending upon the end caps and attachment members selected.

Additional objects, features and advantages of the present invention will be more readily apparent from the following detailed description when taken in conjunction with the drawings wherein like reference numerals refer to corresponding parts in the several views.

DETAILED DESCRIPTION OF THE PREFERRED EMBODIMENTS

Figure 1:
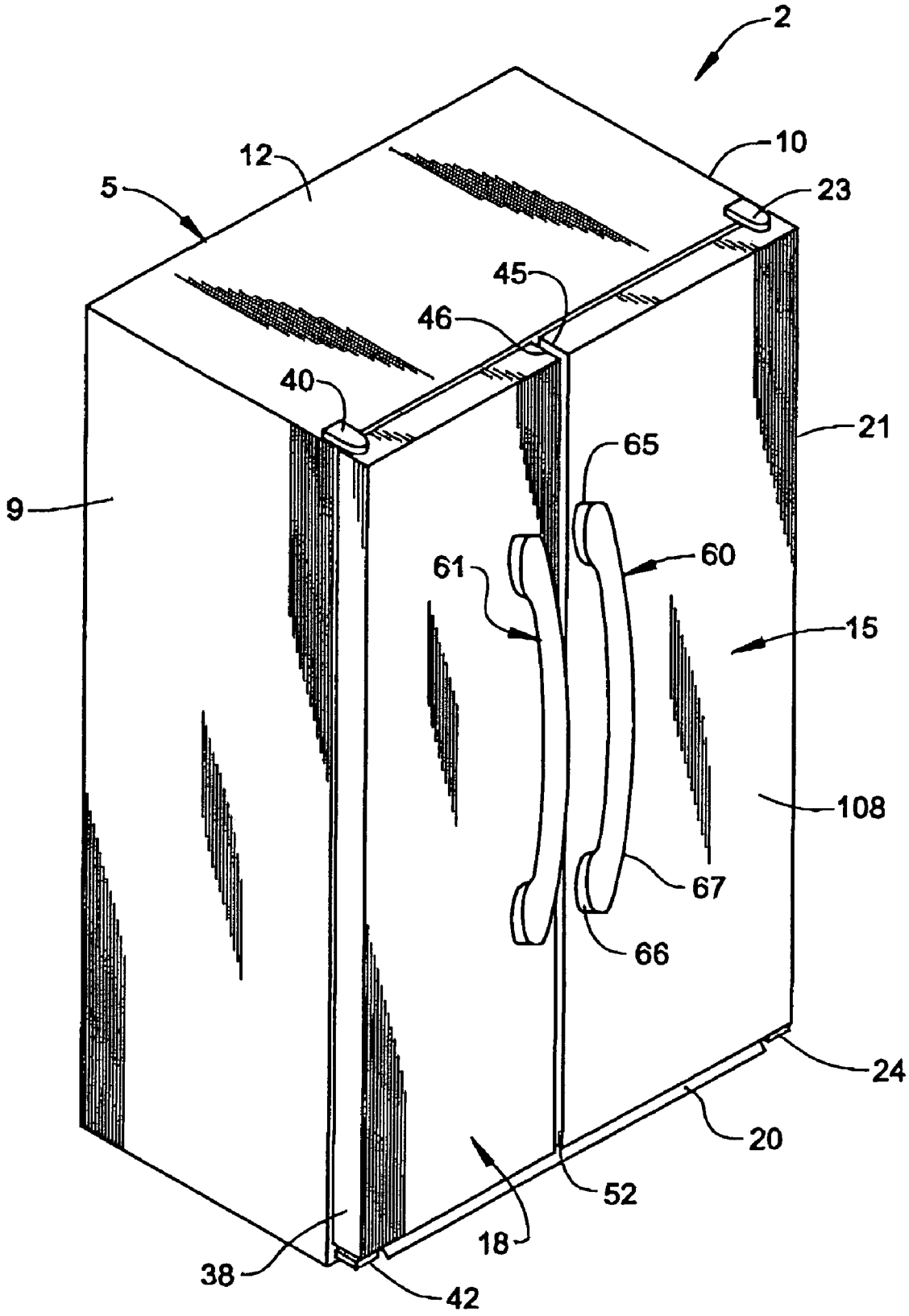
FIG. 1 is an upper left perspective view of a refrigerator cabinet incorporating a refrigerator door handle assembly constructed in accordance with the present invention shown in a front mount arrangement.

With reference to FIG. 1, the handle assembly of the invention is shown mounted into a refrigerator which is generally indicated at 2. Initially, it should be noted that the handle assembly can be applied to various different types and styles of refrigerators. However, as shown, refrigerator 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator 2 constitutes a side-by-side refrigerator having a fresh food compartment door 15 which is arranged laterally juxtaposed a freezer door 18. Extending laterally across cabinet shell 5, below fresh food and freezer doors 15 and 18, is a kick plate 20. Fresh food door 15 includes an outer vertical edge portion 21 which is pivotally attached to cabinet shell 5 through an upper hinge 23 and a lower hinge 24.

In a generally similar manner, freezer door 18 includes an outer edge portion 38 which is pivoted at upper hinge 40 and lower hinge 42 for movement relative to cabinet shell 5. In a manner widely known in the art, side-by-side refrigerator 2 has inner edge portions 45 and 46 of fresh food and freezer doors 15 and 18 spaced by a vertical gap 52. Also widely known, fresh food and freezer doors 15 and 18 conceal fresh food and freezer compartments (not shown) of refrigerator 2. Aside from the aspects which will be described more fully below, the basic construction and operation of refrigerator 2 is known in the art, does not form part of the present invention, and therefore will not be discussed further herein.

The present invention is actually directed to the mounting of handle assemblies 60 and 61 for fresh food and freezer doors 15 and 18 respectively. As shown, each handle assembly 60, 61 includes a first end cap 65, a second end cap 66, and a main body portion 67 spanning between the first and second end caps 65 and 66. At this point, it should be understood that the exact configuration of handle assemblies 60 and 61 merely represents a preferred arrangement and various handle configurations, particularly for main body portion 67, could be readily employed without departing from the invention.

Figure 2:
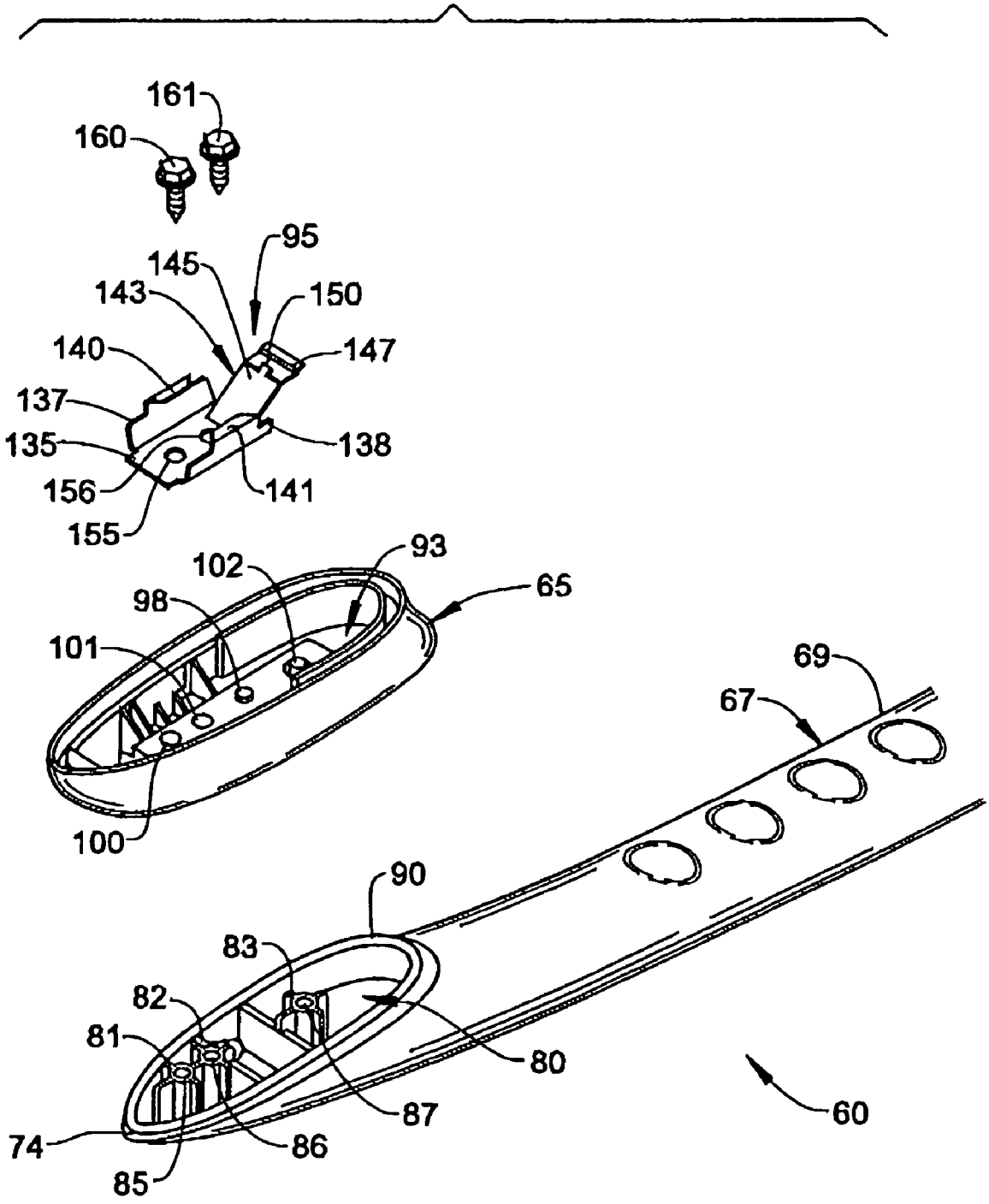
FIG. 2 is a partial exploded view of an end of the handle assembly of FIG. 1.
Figure 3:
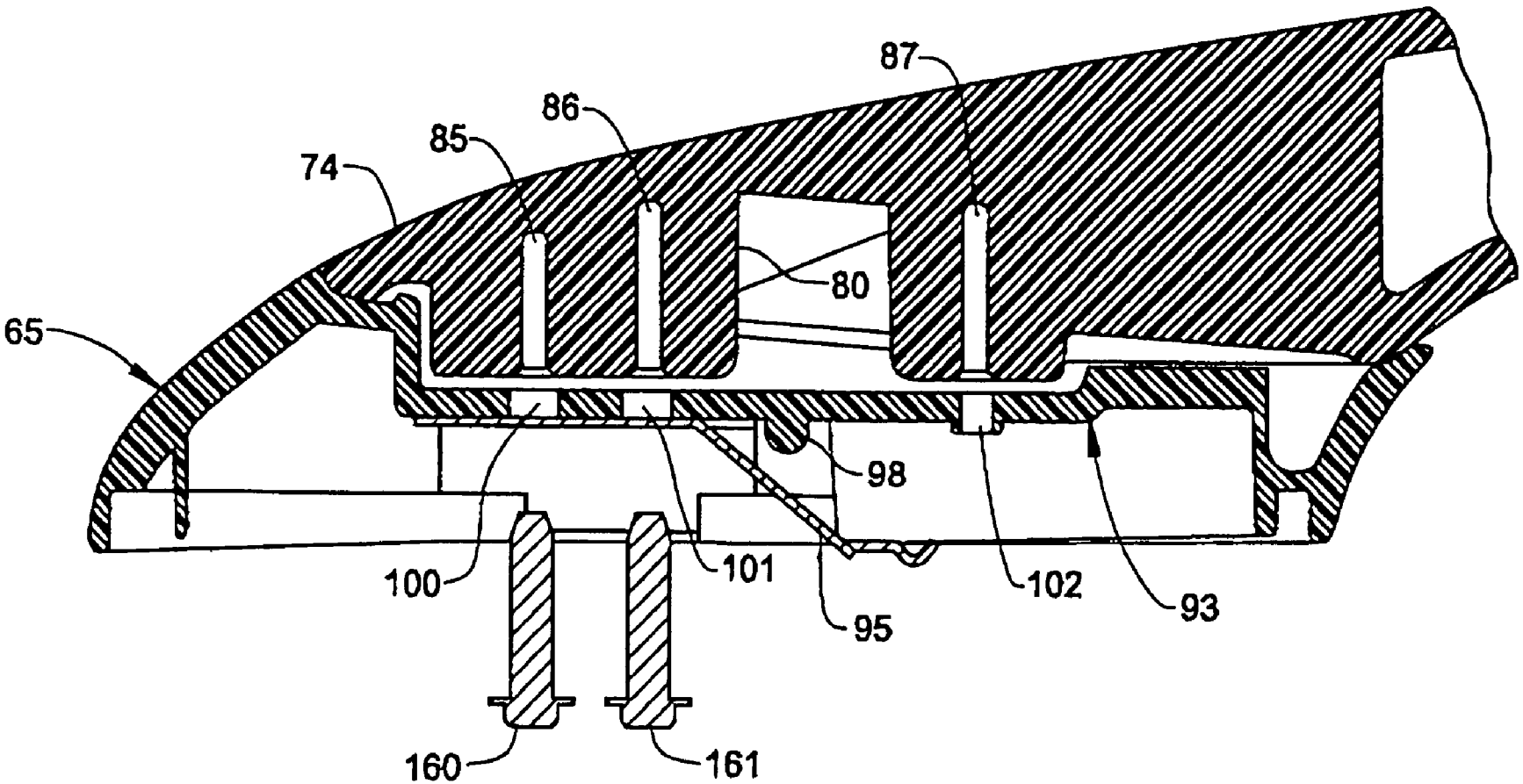
FIG. 3 is a cross-sectional view of the end of the handle assembly of FIG. 2.
Figure 4:
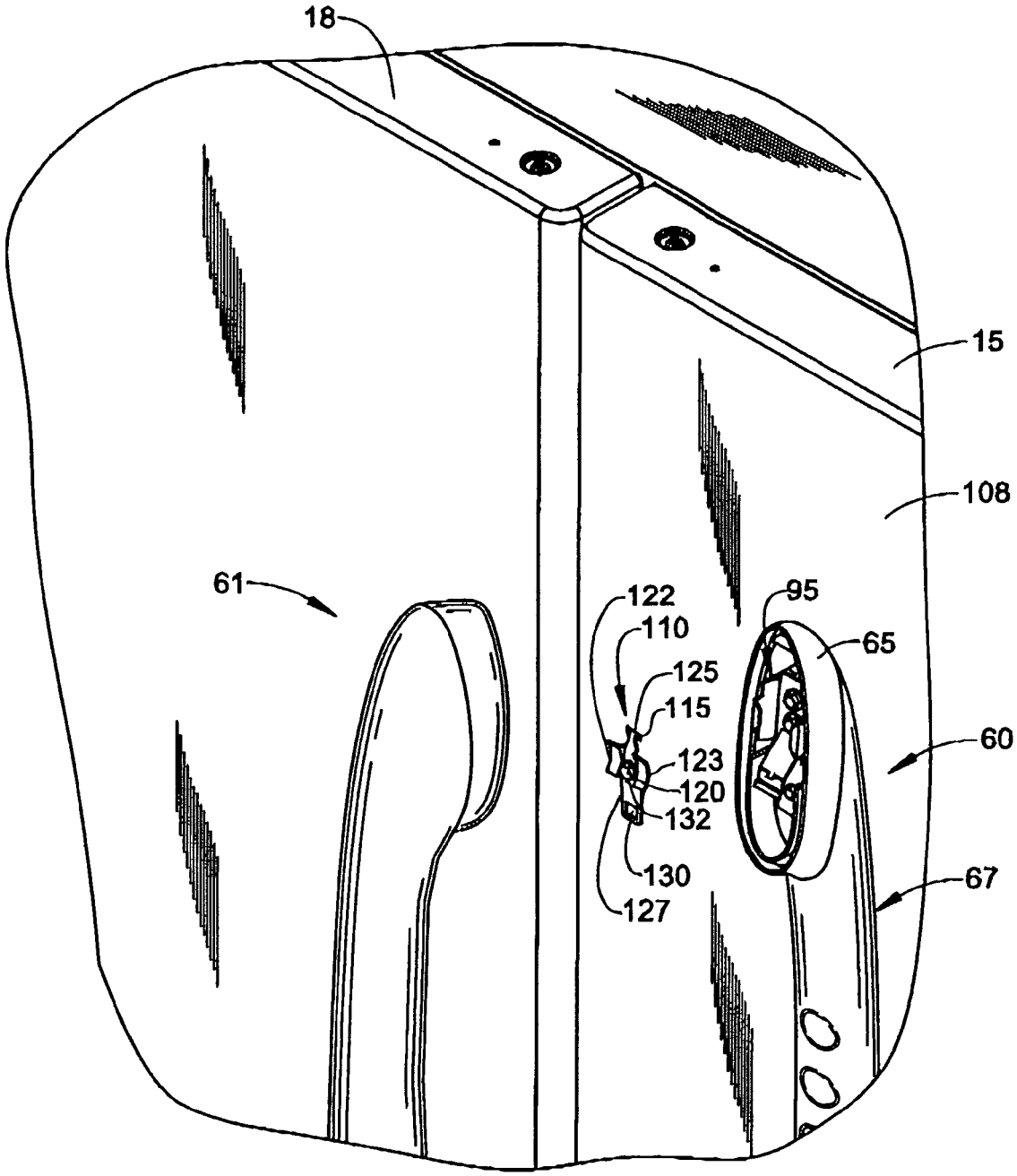
FIG. 4 is an exploded view of the handle assembly of FIGS. 1-3 depicting the attachment of the handle assembly to a refrigerator door.
Figure 5:
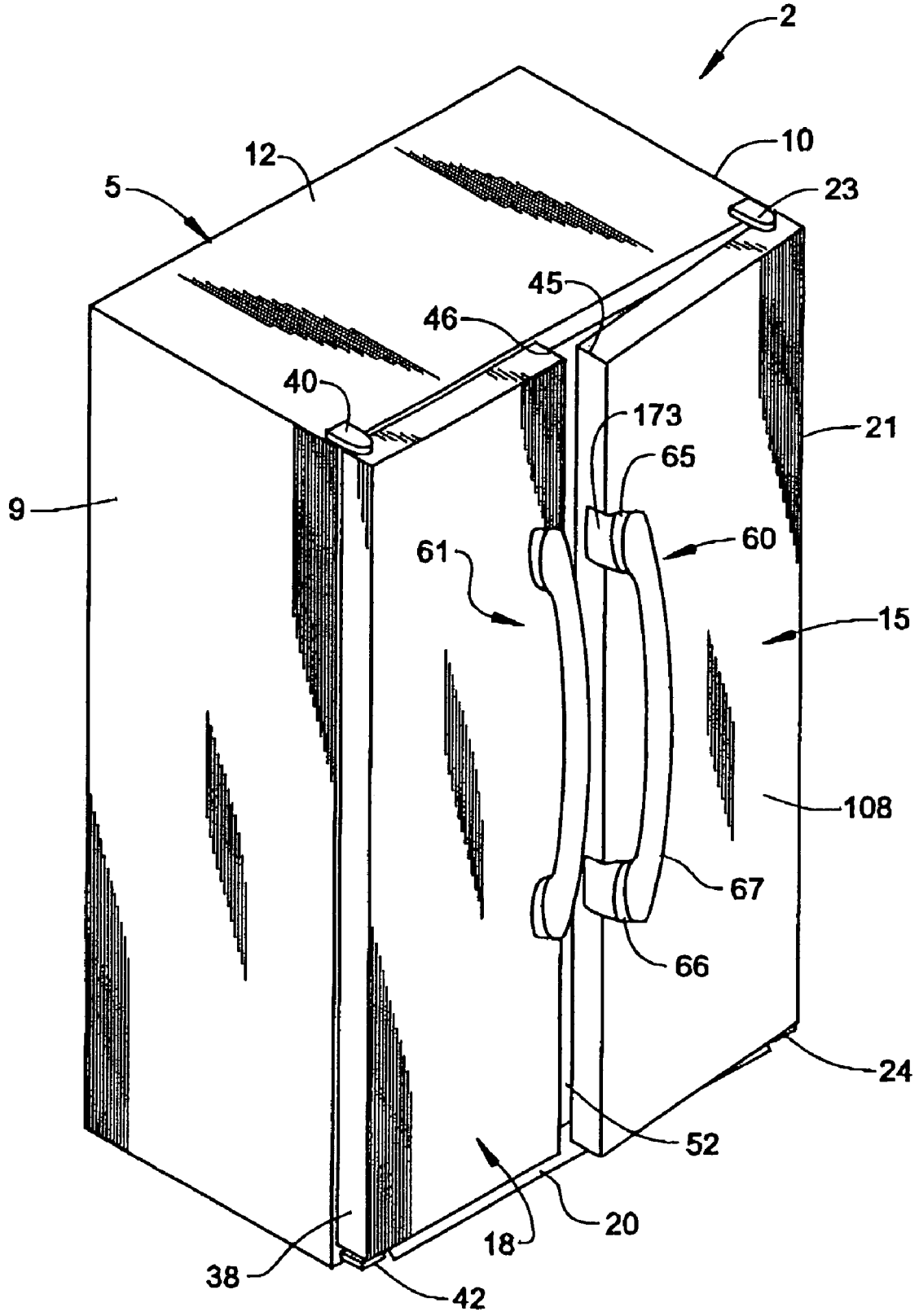
FIG. 5 is an upper left perspective view of a refrigerator cabinet incorporating an alternative embodiment of the refrigerator door handle assembly constructed in accordance with the present invention shown in a side mount arrangement.
Figure 6:
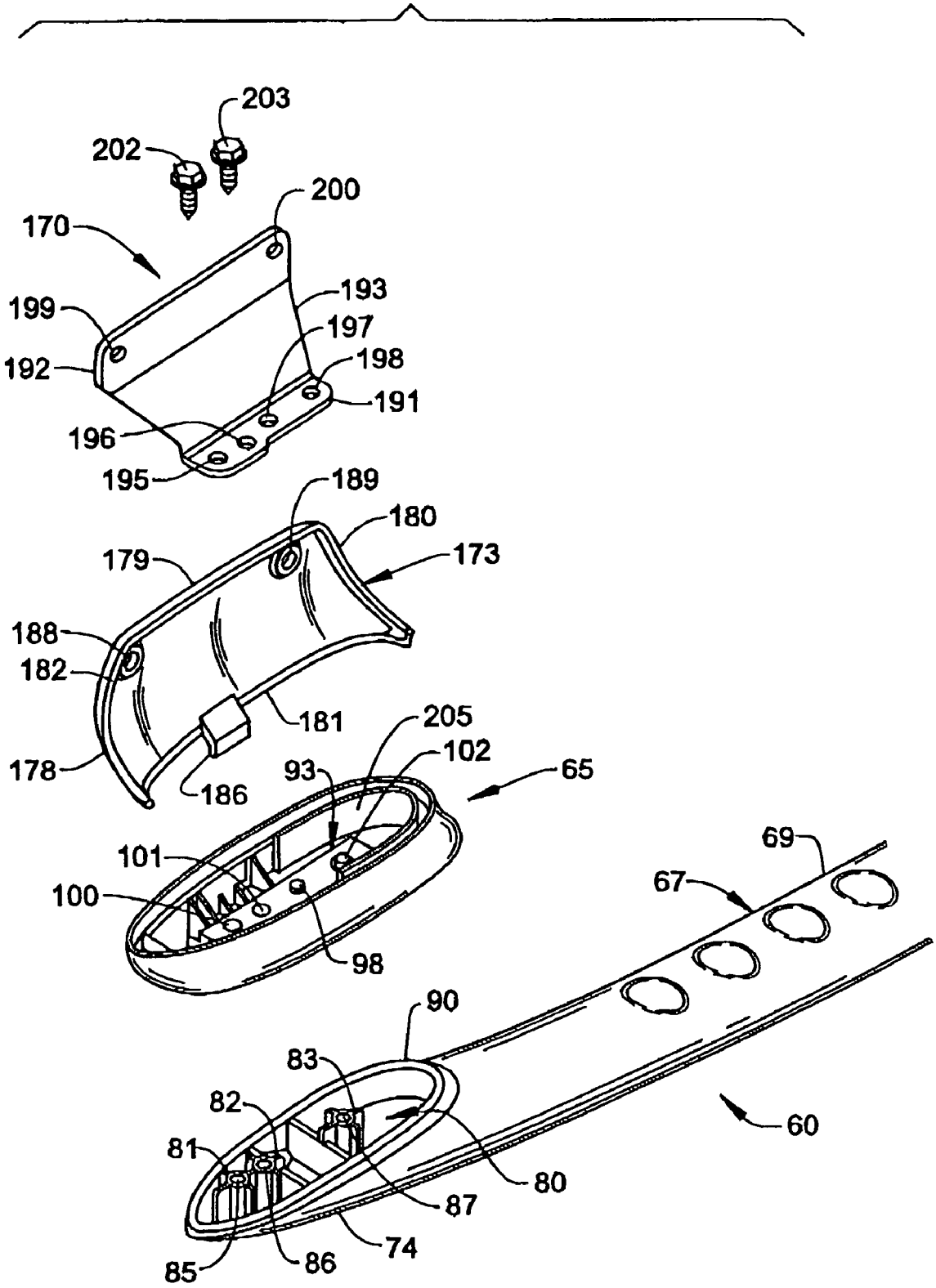
FIG. 6 is an exploded view of an end of the handle assembly of FIG. 5.
Figure 7:
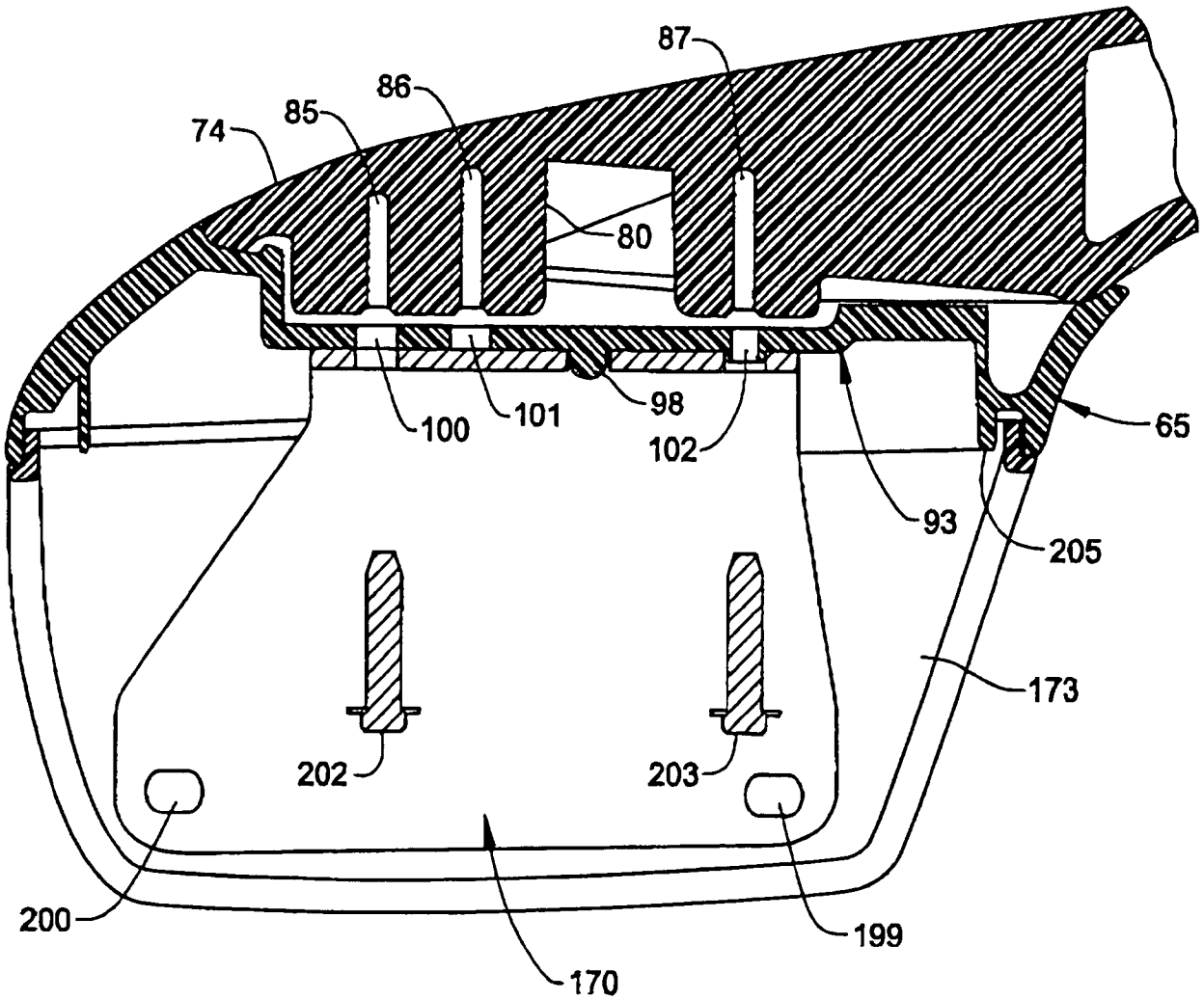
FIG. 7 is a cross-sectional view of the end of the handle assembly of FIG. 6.

Reference will now be made to FIGS. 2-4 in describing a first embodiment of handle assembly 60 in accordance with the present invention and it should be understood that handle assembly 61 is constructed and mounted in a corresponding manner. With initial reference to FIG. 2, main body portion 67 is preferably molded of plastic and includes an intermediate section 69 leading to first and second ends 74 and 75 (also see FIG. 1). At this point, it should be realized that, although reference will be made to only first end 74 of main body portion 67, second end 75 includes identical components. First end 74 includes a recessed section 80 including first, second, and third spaced apart bosses 81-83, preferably with threaded bores 85-87 formed therein. Further, an upstanding lip 90 is formed around a periphery of first end 74 to assist in positioning first end cap 65 over first end 74.

As best shown in FIGS. 2 and 3, first end cap 65 is formed with an internal mounting arrangement 93 for attaching a handle clip 95 to end 74. Mounting arrangement 93 includes a locating projection 98 and apertures 100-102. When first end cap 65 is positioned over end 74, apertures 100-102 are aligned with threaded bores 85-87, through which handle clip 95 is attached to end 74, as will be discussed in detail below.

As shown in FIG. 4, in this first embodiment, handle assembly 60 is attached to a front face portion 108 of fresh food door 15. Actually, a door clip member 110 is mounted to front face portion 108 of fresh food door 15, and handle clip 95 is fastened to main body portion 67. Fresh food door 15 is provided with a hole (not shown) and an opening 115. In accordance with a preferred form of the invention, door clip 110 includes a main base section 120 which defines a pair of spaced side connectors 122 and 123. As depicted, each side connector 122, 123 is generally concave in shape, while defining an arcuate or convexly curved lower surface (not separately labeled). Projecting from one end of main base section 120 is a tab member 125. Projecting from another end of main base section 120 is a leg extension 127 provided with a through hole 130, which is generally rectangular or square in shape. Main base section 120 is also provided with a substantially central aperture (not shown). Door clip member 110 is mounted with tab member 125 projecting into opening 115 and the central aperture of door clip member 110 being aligned with the hole provided in fresh food door 15. Thereafter, a mechanical fastener 132, such as a sheet metal screw, extends through the aperture and is threadably attached to fresh food door 15 at the hole to fixedly secure door clip member 110 to door 15. At this point, it should be realized that the structure and mounting method of door clip member 110 can be readily varied without departing from the invention.

Again referencing FIG. 2, handle clip member 95 includes a base portion 135, upstanding side wall portions 137 and 138, in-turned flange members 140 and 141 stemming from side wall portions 137 and 138 respectively, and a cantilevered arm 143. As shown, arm 143 includes a first angled section 145, preferably extending at an angle of approximately 36° from base portion 135, leading to a catch section 147. First angled section 145 preferably projects from base portion 135 a distance slightly greater than the height of side wall portions 137 and 138. In this manner, catch section 147 extends substantially parallel to flange members 140 and 141, while being spaced from base portion 135 a distance greater than flange members 140 and 141. First angled section 145 is actually lanced and bent such that a clip member 150 is defined at catch section 147. In addition, base portion 135 is provided with a pair of spaced holes 155 and 156.

Handle clip member 95 is fastened to main body portion 67 with fasteners 160 and 161. More particularly, handle clip 95 is positioned over mounting arrangement 93 such that holes 155 and 156 of handle clip 95 are aligned with apertures 100 and 101 of first end cap 65, as well as bores 85 and 86 of bosses 81 and 82. Fasteners 160 and 161 are then preferably threadably attached to bosses 81 and 82 to complete the assembly. For this purpose, fasteners 160 and 161 can be self-tapping. On the other hand, a press-fit or other mechanical connection could also be employed. Following the mounting of handle clip 95 to main body portion 67, end cap 65 can be completely laid over door clip 110, with door clip 110 being initially arranged adjacent handle clip 95. Thereafter, the entire handle assembly 60 is shifted or slid relative to door clip 110 and door 15. Due to the shape of the side connectors 122 and 123, the shifting of handle 60 causes side connectors 122 and 123 to engage flange members 140 and 141. Therefore, as handle 60 is shifted in this manner, a wedging action results that causes handle 60 to be draw against door 15. That is, door clip 110 and handle clip 95 include mating surfaces which co-act to draw handle 60 to front face portion 108 of door 15. With the shifting of handle 60, leg extension 127 engages arm 143 and causes arm 143 to initially deflect. Thereafter, arm 143 will snap back as clip member 150 projects into through hole 130. Once this snap connection is established, essentially simultaneously at both first and second end portions 74 and 75, handle assembly 60 is fixed in position along door 15.

Reference will now be made to FIGS. 5-8 in describing a second embodiment of the invention wherein handle assembly 60 is mounted to inner vertical edge 45 of fresh food door 15. In this embodiment, bracket 170, which is preferably formed of steel, is used to fasten first end 74 to inner vertical edge 45. Initially, end cap 65 is positioned over first end 74 as previously described. Preferably, a cover member 173 is then attached to first end 74 for concealing bracket 170, as will be discussed below. Cover member 173 includes edges 178-181. A lip 182 extends outward from edges 178-180 for abutting inner vertical edge 45 of fresh food door 15. A tab 186 extends downward from edge 181 for holding cover member 173 in place after bracket 170 is attached. Cover member 74 also includes holes 188 and 189 formed adjacent edge 179.

Bracket 170 includes a first portion 191, a second portion 192 extending substantially perpendicular to first portion 191, and an angled middle portion 193 interconnecting first and second portions 191 and 192. First portion 191 includes spaced apart apertures 195-198 for cooperating with mounting arrangement 93 and second portion 192 includes spaced apart apertures 199 and 200 which align with holes 188 and 189 and cooperate with a pair of mechanical fasteners 202 and 203 as will be discussed in detail below.

Prior to attaching handle assembly 60 to inner vertical edge 45, bracket 170 and cover member 173 are attached to end 74 through end cap 65. Initially, cover member 173 is positioned against end cap 65 such that edge 181 of cover member 173 is held in position by a positioning ledge 205 formed within end cap 65. When cover member 173 is in place, first portion 191 of bracket 170 is positioned over mounting arrangement 93 such that locating projection 98 extends into aperture 197 and apertures 195 and 198 align with apertures 100 and 102, as well as bores 85 and 87 of bosses 81 and 83 respectively. Mechanical fasteners, such as screws 202 and 203, extend through the respective apertures 195, 100 and 198, 102 and are threaded to bosses 81 and 83 to fasten bracket 170 to end 74. When bracket 170 is attached to mounting arrangement 93, bracket 170 prevents tab 186 from moving and therefore holds cover member 173 in place. Holes 188 and 189 on cover member 173 are aligned with apertures 199 and 200 of bracket 170.

Figure 8:
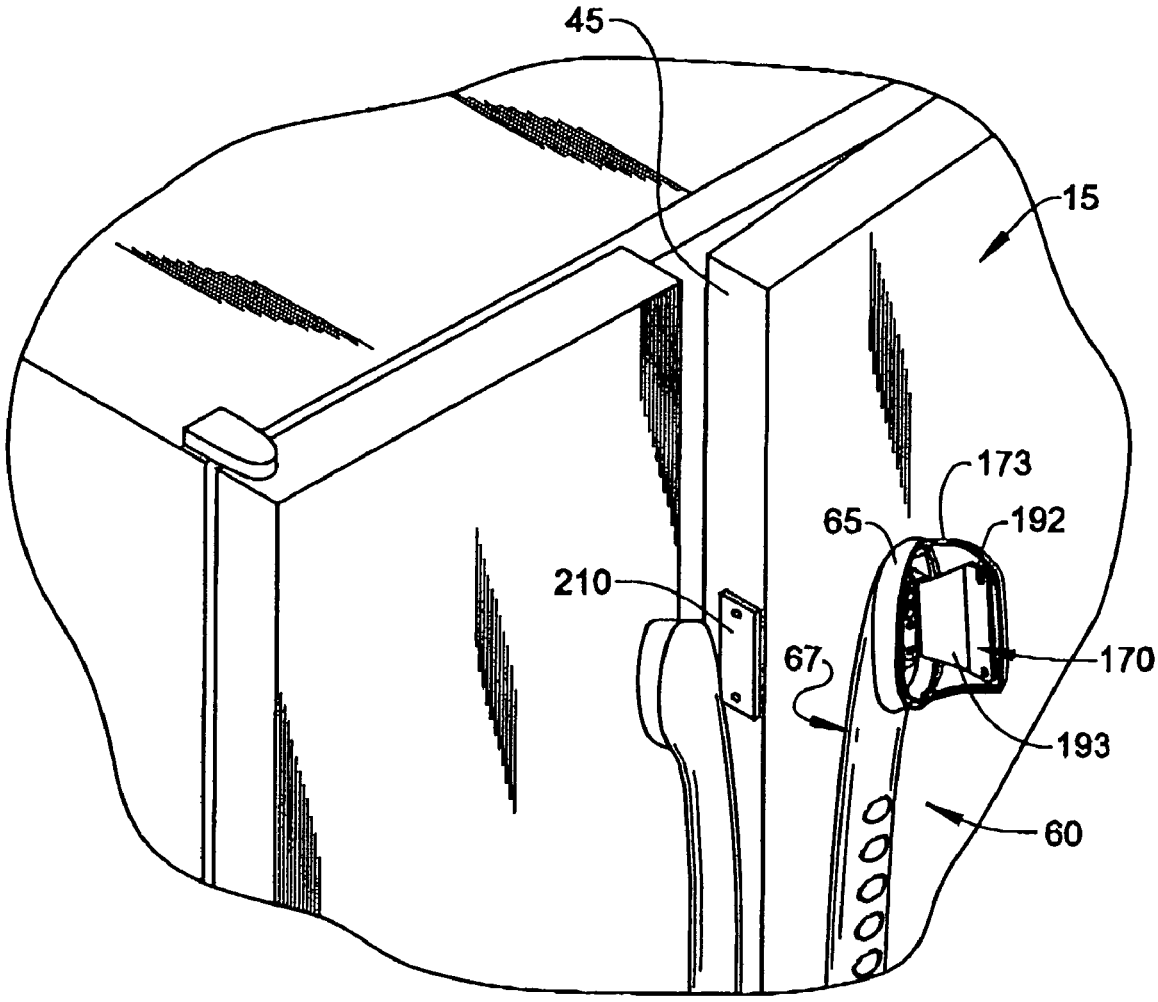
FIG. 8 is an exploded view of the handle assembly of FIGS. 5-7 depicting the attachment of the handle assembly to the refrigerator door.
Figure 9:
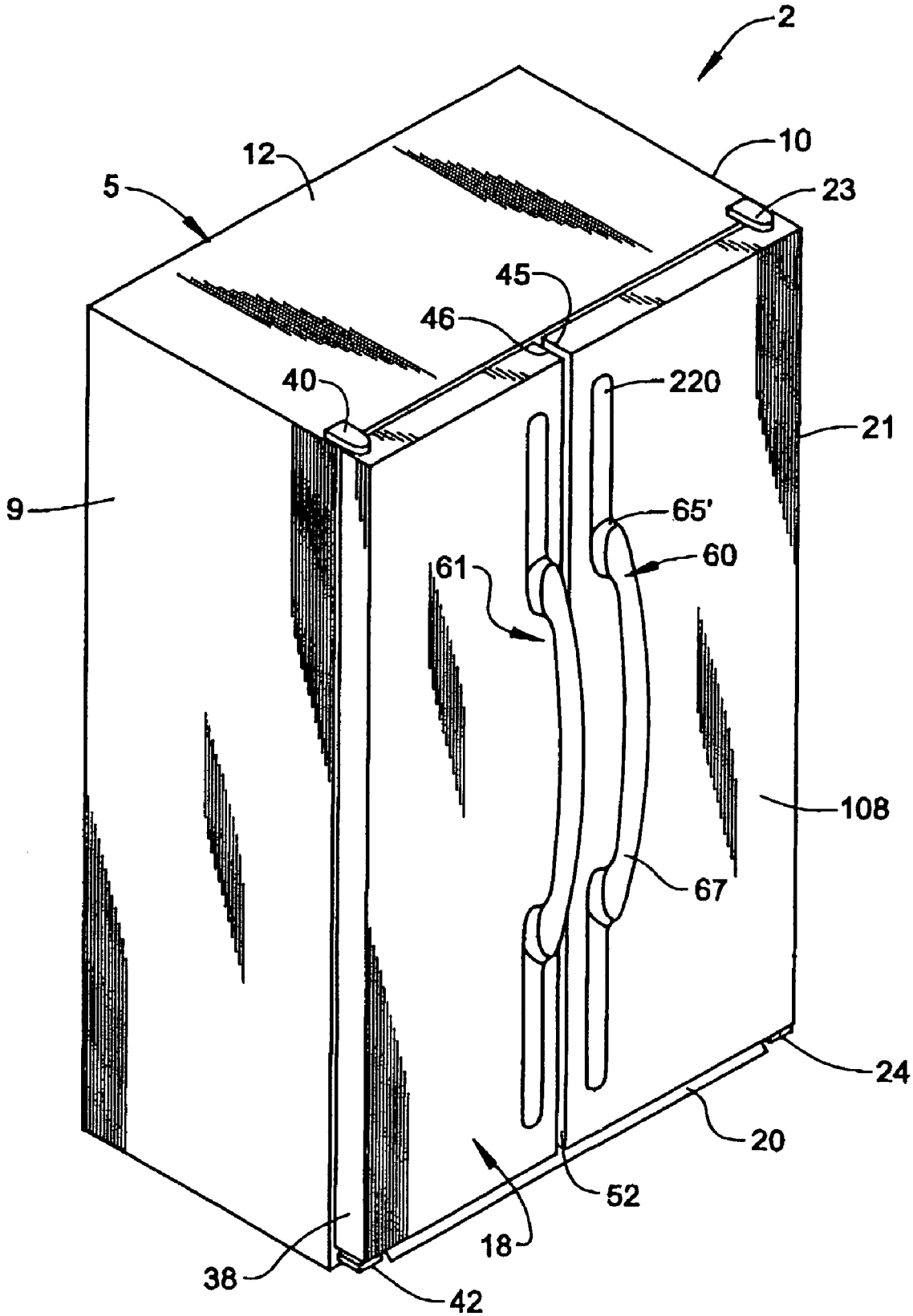
FIG. 9 is an upper left perspective view of a refrigerator cabinet incorporating another alternative embodiment of the refrigerator door handle assembly constructed in accordance with the present invention shown in a front mount arrangement.

Steel plates, one of which is indicated at 210 in FIG. 8, are provided with holes (not separately labeled), with each plate 210 being affixed to inner vertical edge 45 of door 15 at spaced distances to provide a metal contact surface for attaching handle assembly 60. Mechanical fasteners, such as screws (not shown), extend through holes 188 and 189 on cover member 173 and apertures 199 and 200 of bracket 170 and into the holes on the steel plate to secure handle assembly 60 to door 15. Second portion 92 of bracket 170 directly contacts plate 210 when handle assembly 60 is mounted in this manner. Therefore, due to this metal to metal attachment, there will be less loosening of the handle over time. However, it should be noted that the use of plates 210 is optional.

Figure 10:
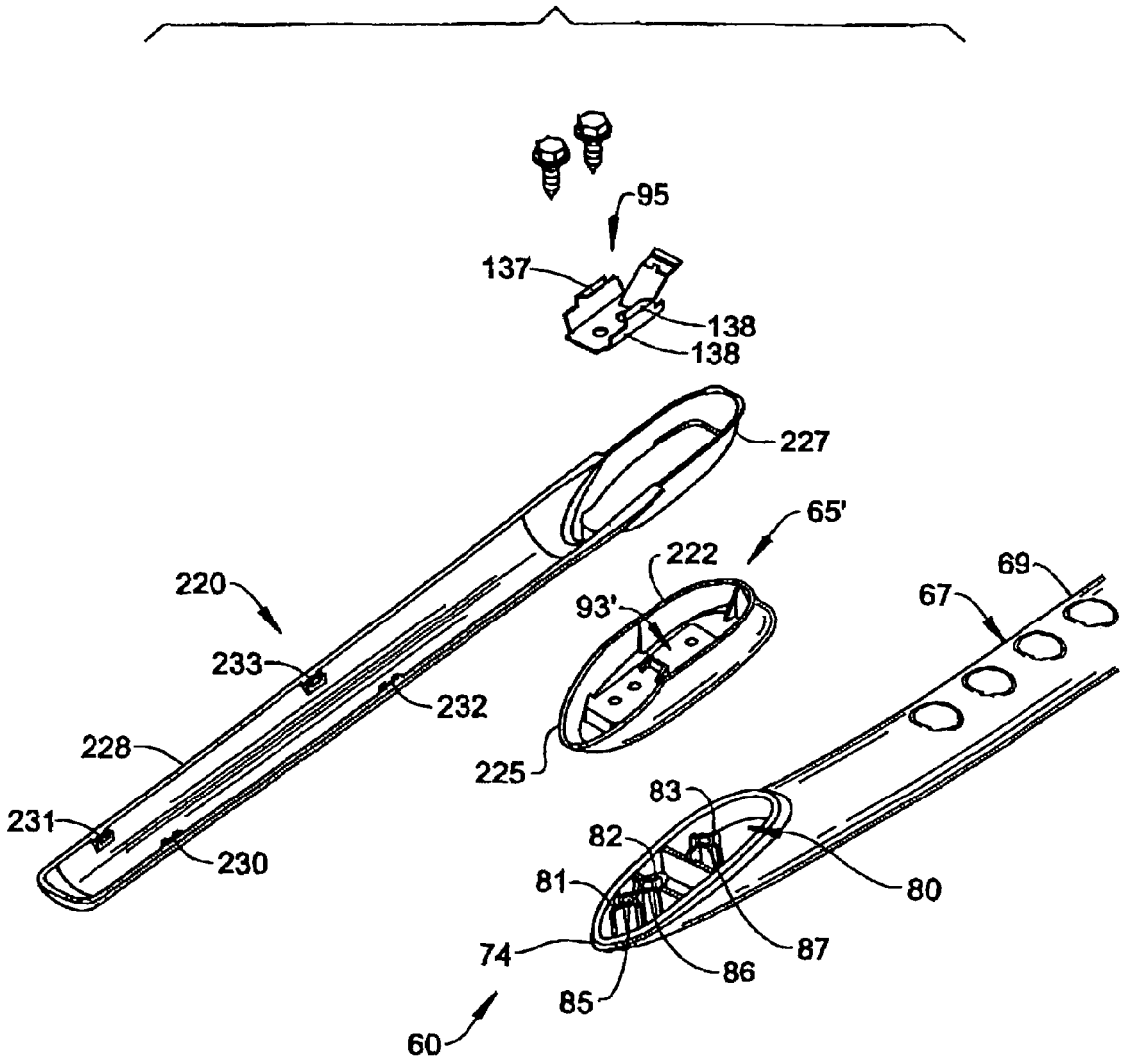
FIG. 10 is an exploded view of an end of the handle assembly of FIG. 9.
Figure 11:
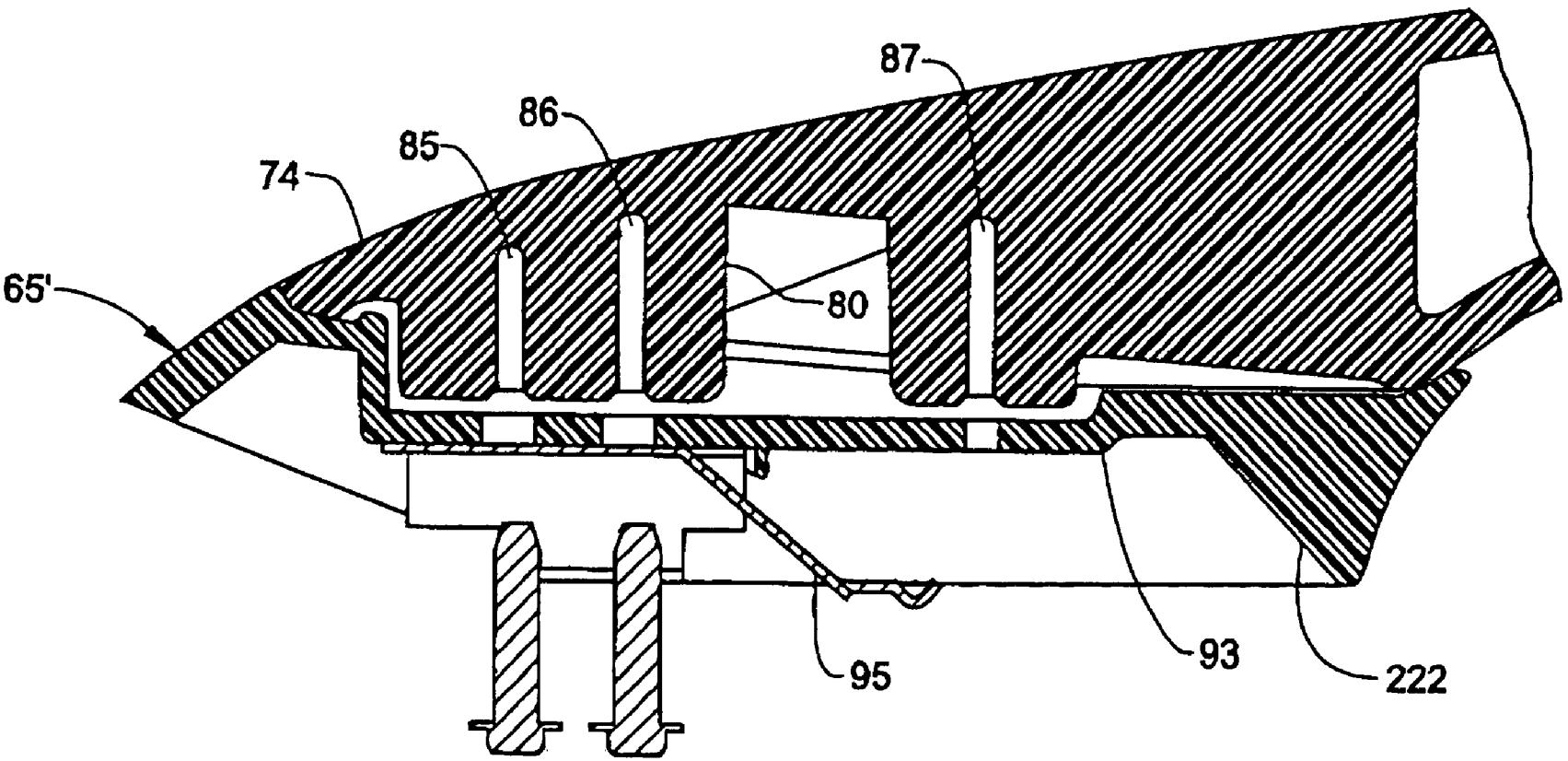
FIG. 11 is a cross-sectional view of the end of the handle assembly of FIG. 10.
Figure 12:
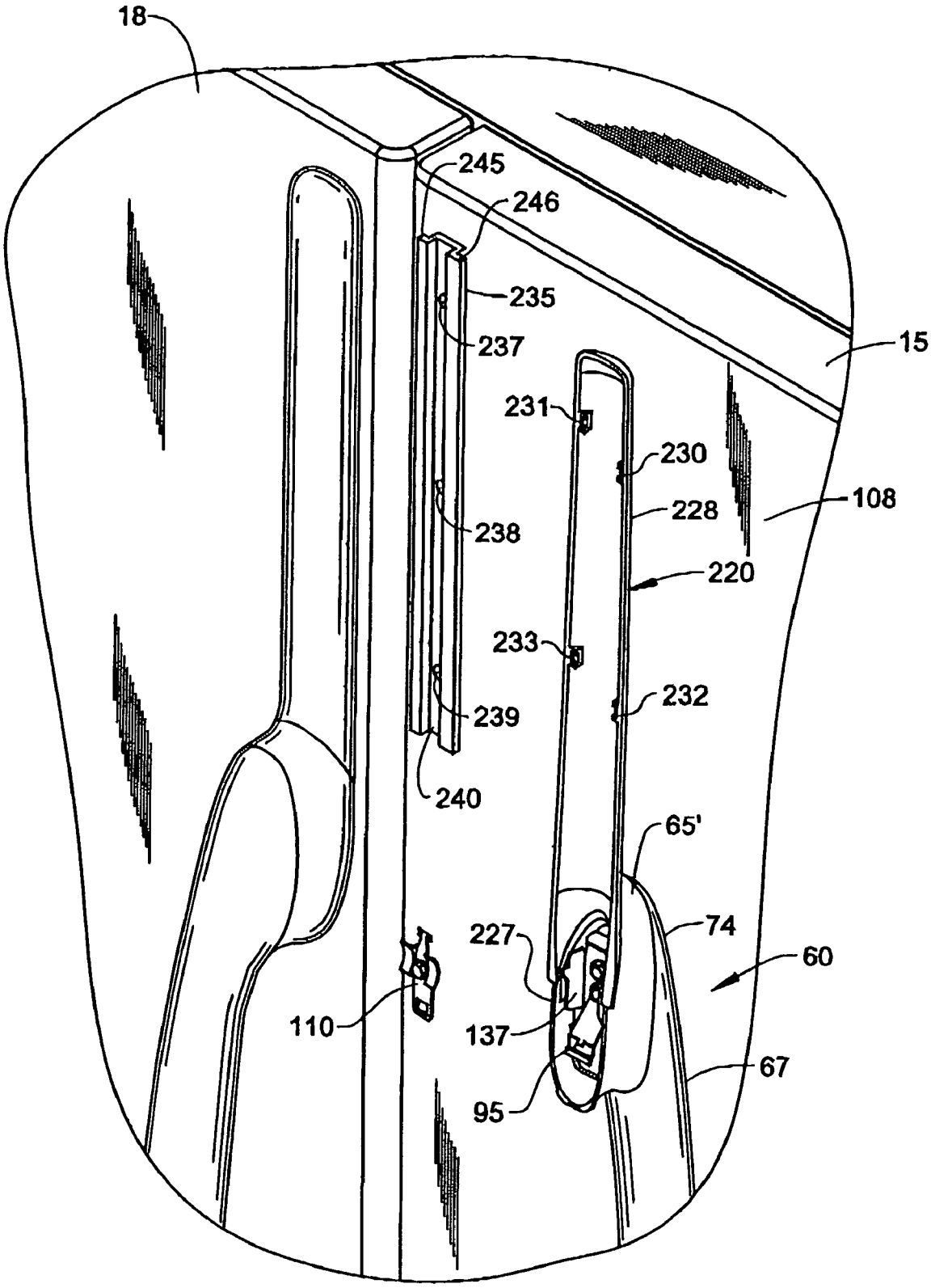
FIG. 12 is a view of the handle assembly of FIGS. 9-11 depicting the attachment of the handle assembly to the refrigerator door.

With reference to FIGS. 9-12, another alternative embodiment of the invention will be described. In this embodiment, handle assembly 60 is further provided with upper and lower elongated extensions 220 projecting from main body portion 67. In a manner similar to that described for the previous embodiments, a first end cap 65' is attached to main body end 74. More specifically, end cap 65' includes a mounting arrangement 93' and an upstanding wall 222 around the perimeter thereof. Upstanding wall 222 has a reduced tail end portion 225 for accommodating elongated extension 220. As best shown in FIG. 10, elongated extension 220 includes a first portion 227 that fits within end cap 65' at reduced tail end portion 225 and a second portion 228 that extends along front face portion 108 of fresh food door 15. Second portion 228 includes tabs 230-233 for engaging a base plate 235, as will be described below.

Following the positioning of elongated extension 220 within end cap 65', handle clip 95 is fastened to first end 74 of main body portion 67 through end cap 65'. The structure and mounting of handle clip 95, as well as door clip 110, is identical to that described with reference to FIGS. 1-4. Therefore, the details will not be discussed again herein. However, it should be noted that upstanding side walls 137 and 138 of handle clip 95 press against first portion 227 of elongated extension 220, thereby holding elongated extension 220 within end cap 65'. In addition to the attachment provided by the mating of handle clip 95 and door clip 110, base plate 235 is fastened to door 15 for mating with tabs 230-233 of elongated extension 220. Base plate 235 (see particularly FIG. 12) includes a plurality of longitudinally spaced holes through which screws 237-239 extend for attaching base plate 235 to door 15. Preferably, base plate 235 is formed of metal or plastic with a substantially flat central section 240, side wall sections (not separately labeled), and outwardly projecting lateral flange sections 245 and 246. Although the exact configuration of base plate 235 could vary greatly in accordance with the present invention, it is important to note that, upon mounting of base plate 235 to door 15, lateral flange sections 245 and 246 will be slightly spaced from the front surface 108 of door 15. When attaching handle assembly 60 to door 15, handle assembly 60 is shifted relative to door 15, as previously described. However, in connection with this embodiment, tab members 230-233 slide behind lateral flange sections 245 and 246 to hold elongated extension 220 against door 15 while handle clips 95 engage door clips 110.

With each of the embodiments described, main body portion 67 is the same. As previously discussed, each of first and second ends 74 and 75 is formed with recessed section 80 having bosses 81-83 with bores 85-87 formed therein. With this arrangement, various end caps and attachment members may be used with main body portion 67 which allows main body portion 67 to be readily employed on a variety of different types of refrigerators. Therefore, only the end caps and attachments need to be separately produced for each type of refrigerator, while the main handle assembly is universally employed.

Although described with reference to preferred embodiments of the invention, it should be understood that various changes and/or modifications can be made without departing from the spirit of the invention. For instance, although described with reference to a side-by-side refrigerator, corresponding handle assemblies could be equally employed in a top mount or bottom mount style refrigerator. In any event, the invention is only intended to be limited in accordance with scope of the following claims.

I claim:

1. A refrigerator comprising:

a cabinet defining an interior compartment;

a door, having a front face portion and a side edge, pivotally mounted to the cabinet for selectively accessing the interior compartment; and a handle system for shifting the door relative to the cabinet, said handle system being selectively mounted to the front face portion or the side edge of the door, said handle system including:

a main body member including first and second end portions;

a first end cap provided between the first end portion of the main body member and the front face portion of the door;

a second end cap provided between the second end portion of the main body member and the front face portion of the door;

a first attachment member configured to mount the main body member to the front face portion of the door; and a second attachment different from the first attachment member and configured to mount the main body member to the side edge of the door;

wherein the main body member is located on the front face portion and selectively fastened to one of the front face of the door and the side edge of the door by selecting one of the first and second attachment members according to the fastening location and the selected one of the first and second attachment member is used to fix the respective first and second end portions of the main body member through the respective first and second end caps.

2. The refrigerator according to claim 1, wherein each of the first and second attachment members is constituted by a clip.

3. The refrigerator according to claim 2, further comprising first and second base members mounted to the front face portion for engaging the first and second clips.

4. The refrigerator according to claim 1, wherein each of the first and second attachment members is constituted by a bracket.

5. The refrigerator according to claim 4, wherein each of the brackets has a first portion and a second portion extending at an angle to the first portion, the first portion being attached to the main body member through a respective one of said first and second end caps and the second portion being attached to the side edge of the door.

6. The refrigerator according to claim 5, further comprising a cover member for concealing the second portion of the bracket.

7. The refrigerator according to claim 1, wherein said first and second end portions of the main body member include recessed sections, said first and second end caps being received in the recessed sections.

8. The refrigerator according to claim 7, wherein each recessed section includes first, second and third spaced apart bosses having threaded bores formed therein.

9. The refrigerator according to claim 1, wherein each of the first and second end caps is formed with an internal mounting arrangement for attaching a respective one of the first and second attachment members to the main body member.

10. The refrigerator according to claim 9, wherein each internal mounting arrangement includes first, second and third apertures for receiving fasteners and a locating projection, said first and second apertures being used when the first and second attachment members are of one of a clip and a bracket and said first and third apertures and the locating projection being used when the first and second attachment members are of the other of the clip and bracket.

11. The refrigerator according to claim 1, wherein the first end cap includes a reduced tail end portion.

12. The refrigerator according to claim 11, further comprising an extension member, said extension member being partially positioned within the first end cap, with the extension member projecting from the reduced tail end portion.

13. A method of assembling a handle to a selective one of a front face and a side edge of a refrigerator door comprising:

providing a handle;

selecting first and second end caps;

selecting a first attachment member, with the first attachment member to be of a first type when the handle is to be mounted to the front face of the door or of a second type when the handle is to be attached to the side edge of the door;

selecting a second attachment member, with the second attachment member to be of the first type when the handle is to be mounted to the front face of the door or of the second type when the handle is to be attached to the side edge of the door;

fastening the first attachment member to a first end portion of the handle with the first end cap interposed therebetween and positioned on the front face of the door, thereby securing the first end cap to the handle;

fastening the second attachment member to a second end portion of the handle with the second end cap interposed therebetween and positioned on the front face of the door, thereby securing the second end cap to the handle; and selectively attaching the handle and the first and second end caps to the front face or the side edge of the door through the first and second attachment members.

14. The method of claim 13, wherein each of the first and second attachment members is of the first type and is constituted by a clip such that the handle is clipped to the front face of the door.

15. The method of claim 14, further comprising: attaching first and second base members to the front face of the refrigerator door, said first and second clips engaging the first and second base members.

16. The method of claim 13, wherein each of the first and second attachment members is of the second type and is constituted by a bracket such that the handle is attached to the side edge of the door through the brackets.

17. The method of claim 16, wherein each bracket has a first portion and a second portion extending at an angle to the first portion, with the first portion being attached to the handle through a respective one of said first and second end caps and the second portion being attached to the side edge of the door.

18. The method of claim 17, further comprising: attaching a cover member to the handle for concealing the second portion of the bracket.

19. The method of claim 13, further comprising: attaching an extension member to the handle.

20. The method of claim 19, wherein the first end cap includes a reduced tail end portion, said extension member being positioned within the first end cap such that the extension member projects from the reduced tail end portion.

* * * * *